US009408418B2

(12) United States Patent
Blibech

(10) Patent No.: US 9,408,418 B2
(45) Date of Patent: Aug. 9, 2016

(54) KNITTED BOXER SHORT WITH IMPROVED CROTCH BOTTOM AND ITS CONFECTION METHOD

(71) Applicant: DBAPPAREL OPERATIONS, Rueil-Malmaison (FR)

(72) Inventor: Ragheb Blibech, Paris (FR)

(73) Assignee: DBApparel Operations, Rueil-Malmaison (FR)

( * ) Notice: Subject to any disclaimer, the term of this patent is extended or adjusted under 35 U.S.C. 154(b) by 0 days.

(21) Appl. No.: 14/646,331

(22) PCT Filed: Nov. 14, 2013

(86) PCT No.: PCT/FR2013/052744
§ 371 (c)(1),
(2) Date: May 20, 2015

(87) PCT Pub. No.: WO2014/080110
PCT Pub. Date: May 30, 2014

(65) Prior Publication Data

US 2015/0296891 A1 Oct. 22, 2015

(30) Foreign Application Priority Data

Nov. 20, 2012 (FR) ..... 12 61019

(51) Int. Cl.
*A41B 9/00* (2006.01)
*D04B 1/24* (2006.01)
*D04B 35/34* (2006.01)

(52) U.S. Cl.
CPC ..... *A41B 9/004* (2013.01); *A41B 9/001* (2013.01); *D04B 1/24* (2013.01); *D04B 1/243* (2013.01); *D04B 35/34* (2013.01)

(58) Field of Classification Search
CPC ..... A41B 9/001; A41B 9/04
USPC ..... 2/400, 401, 404, 407, 228, 238, 79
See application file for complete search history.

(56) References Cited

U.S. PATENT DOCUMENTS 2,000,073 A 5/1935 Goas
2,705,801 A * 4/1955 Chubby ..... A41C 1/003 2/401

(Continued)

FOREIGN PATENT DOCUMENTS

CN 1122568 A 5/1996
CN 1214220 A 4/1999

(Continued)

OTHER PUBLICATIONS

International Search Report issued Apr. 1, 2014 re: Application No. PCT/FR2013/052744; citing: FR 2 805 285 A1, WO 2012/087210 A1 and WO 2011/008138.

(Continued)

*Primary Examiner* — Tejash Patel
(74) *Attorney, Agent, or Firm* — Fish & Richardson P.C.

(57) ABSTRACT

These comfortable boxer shorts are formed from a knitted main tube (1) comprising a front part (5) and a back part, the lower portions of which end in a first and second bottom line (10, 11, 16, 11', 10; 13, 12) consisting of two front incisions and one rear incision. The first bottom line (10) (10, 11, 16, 11', 10') is composed of an edge (16) of a front flap (14) and of two bottom line side ends (10, 11; 11', 10') that rise higher than the edge (16) of the flap (14). Said edge (16) of the front flap (14) is sown to the middle of the second bottom line (13, 12), at the rear of the boxer shorts, and two separate crotch parts (15, 15') (15) are sown between the ends (10, 11; 11', 10') of the first bottom line and the ends of the second bottom line (13, 12).

12 Claims, 7 Drawing Sheets

(56) References Cited

U.S. PATENT DOCUMENTS

| | | | | | |
|---|---|---|---|---|---|
| 2,837,904 | A | * | 6/1958 | Scriggins | A41B 9/04 450/101 |
| 3,486,507 | A | * | 12/1969 | Arnold | A41B 9/04 2/401 |
| 4,488,317 | A | * | 12/1984 | Polsky | A41D 1/08 2/227 |
| 2003/0140661 | A1 | | 7/2003 | Bonnin | |

FOREIGN PATENT DOCUMENTS

| | | | |
|---|---|---|---|
| CN | 1336971 | A | 2/2002 |
| CN | 1864570 | A | 11/2006 |
| CN | 102669825 | A | 9/2012 |
| FR | 2805285 | A1 | 8/2001 |
| WO | 2011008138 | A1 | 1/2011 |
| WO | 2012087210 | A1 | 6/2012 |

OTHER PUBLICATIONS

The State Intellectual Property Office of the Peoples Republic of China, Notification of the First Office Action, Chinese Application No. 2013800563630, Mar. 4, 2006, 12 pages.

* cited by examiner

Fig.13A
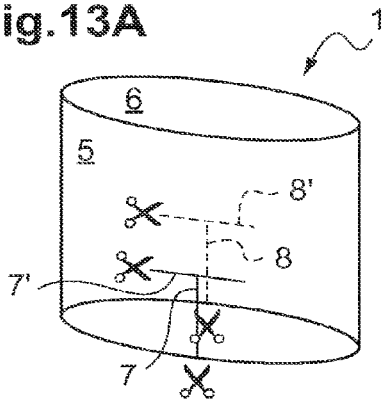
Fig.13'A
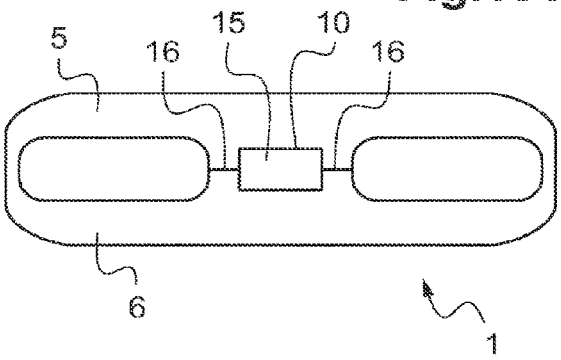
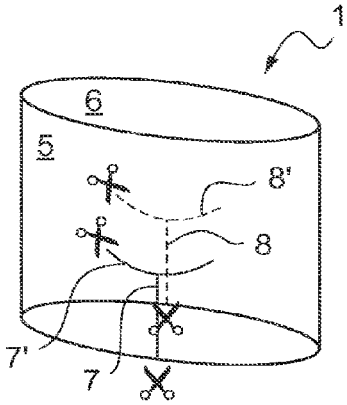
Fig.13B
Fig.13C
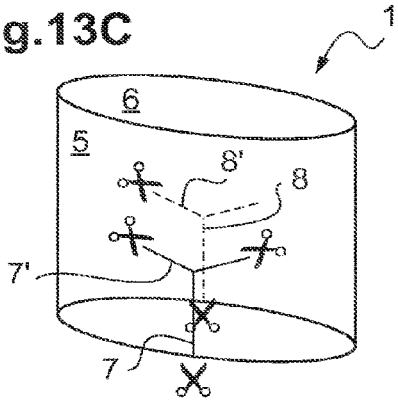
Fig.13'C
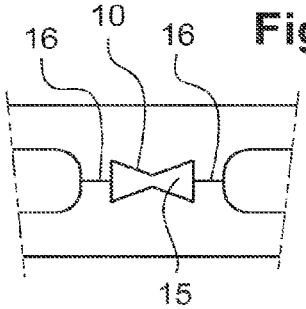

KNITTED BOXER SHORT WITH IMPROVED CROTCH BOTTOM AND ITS CONFECTION METHOD

TECHNICAL FIELD

The present invention relates to a knitted lingerie article corresponding to what is currently marketed under the name "boxer short" and which generally designates a short knitted underpants, for men as well as for women of all ages. It is understood here that the term boxer short is not limited to the short underpants but also extends to long underpants, for example of the type known under the name "long boxer short", "legging", etc.

BACKGROUND

The boxer short is a relatively complex article as it is intended to cover the low part of the trunk as well as the top part of the thighs over a sufficient length. It comprises a panty portion ended at its upper portion by a belt positioned at the waist, and at its lower portion by two lapels separately positioned on the thighs. It is commonly made from a knitted tube corresponding to a diameter allowing to seamlessly dress the low part of the trunk, and is equipped during a confection operation of a sewn crotch bottom allowing to link the two tubes dressing the thighs. We know how to knit on the circular machines such as the machines SANTONI of SM8-8 type, for example for diameters comprised between 10 and 16 inches (between 25 and 40 cm), tubes intended for of the confection of boxer shorts with a double belt in the top portion and a double lapel in the low portion, this tube may be knitted in both directions (belt-lapel or lapel-belt). We also know the confection of the tube bottom to make the low part of the boxer short, with an attached bottom which can be made on the same type of knitting machine. According to the known prior art of documents US2000073 and FR2805285, the crotch bottom or gusset is a substantially rectangular piece which is put between the edges of two slots or incisions performed at the front and at the back of the knitted tube. The enclosed FIGS. 1 to 3 show in more detail this confection operation. The boxer short 101 is made in the shape of a knitted tube, with an upper belt 102 and a lower border 103, where lapels or reinforcements corresponding to future thigh passages are formed or may be formed. The knitted tube 101 comprises a front face 105 and rear face 106 (in one piece since it is about a circular knitting). The portion 104 intended to form the front pocket of the boxer short intended to maintain the genitals is represented by hatching on the front face 105. We proceed (FIGS. 1 and 2) to a cutting operation creating an incision 107 at the front part 105 and an identical or different incision 108 at the back 106 of the knitted tube, in the middle, at its lower portion. The incision 107 has edges 110, 111 and the incision 108 has edges 112, 113. Each incision 107, 108 is then laterally spaced apart and stretched, as suggested by the arrows of FIGS. 1 and 2, so as to put substantially, in the extension of one another, the edges 110, 111 on the one hand and 112, 113 on the other hand, and form thus substantially rectilinear bottom lines which are sewn together by means of a substantially rectangular crotch bottom 115 (called here "bottom lines" the lower edges of the front and the back of the tubular knitted fabric, intended to be sewn to one another, between the thigh passages, directly or by means of additional pieces of crotch bottom such as the gusset). The document FR2805285 had represented an improvement compared to the classical confection by providing bottom lines with a different length at the front and at the back and by making the crotch bottom 115 with different elastic zones at the front and at the back. This suggestion has allowed to partially solve an often encountered problem with this type of garment, namely the absence of wearing comfort, related in particular to the presence of troublesome seams at the crotch and/or to a bad conformation of this bottom to the anatomy of the wearer, and more particularly to the presence of troublesome seams on the front at the genitals, in particular for man. However, the wearing comfort remains to improve further and this is the purpose of the present invention. More precisely, it is about finding a new method for the confection of the crotch, remaining simple, but leading to an improved comfort.

We know, from the documents WO 2012087210 and WO 2011008138, two methods for the confection of boxer shorts from two knitted rectilinear strips which are applied one on the other. These documents teach that it is possible to tie the two strips together according to some patterns of parallel or T lines which are then incised, so as to give rise to particular crotch shapes. These two methods do not relate to the confection of the boxer shorts from tubular knitted fabric and do not give transposable teaching to this manufacturing method.

BRIEF SUMMARY

The purpose of the invention is achieved thanks to a method for manufacturing a boxer short comprising the circular knitting of a main tube, the preparation of a crotch bottom, the cutting in the low portion at the front and at the back of the incisions tube, the opening by lateral extension of the incisions to form first and second globally transverse bottom lines and the sewing of the crotch bottom to the globally transverse bottom lines for forming the crotch and the thighs passage and for confectioning the boxer short, characterized in that we cut, respectively at the front or at the back, two incisions forming, by opening of the incisions, a first globally transverse bottom line composed, on the one hand, of a low transverse edge and, on the other hand, of a top transverse edge of bottom line rising higher than the low transverse edge, in that at least one incision is cut, respectively, at the back or at the front, forming, by opening of the incision, a second bottom line having at least one low transverse edge, in that the crotch bottom is prepared in the shape of at least one crotch piece, and in that said low transverse edge of the first bottom line is sewn to a portion facing the low transverse edge of the second bottom line and in that the at least one crotch piece is sewn between the top edge of the first bottom line and a portion facing the second bottom line.

Preferably, particularly for a male garment, it is at least at the front that the two incisions are cut, the back may have just a single incision. It is indeed at the front that it is mainly appropriate to improve the comfort of the garment. However, it is possible to provide a boxer short where the two incisions are provided at the back and only one at the front. It is also possible, and sometimes even advantageous, to provide a boxer short where the front as well as the back include two incisions.

The incisions may be formed at the front and/or at the back of the knitted tube by simple symmetrical incisions with respect to the median vertical axis of a front or rear face, which are vertical or slightly oblique with respect to the vertical. The incisions are preferably rectilinear, but may also be curved, formed of segments, etc.

The two incisions formed on the front (or rear) side, are in a preferred embodiment, two substantially vertical and symmetrical incisions with respect to the median axis of the boxer short. When the knitted fabric is laterally stretched to open these incisions and form the first globally transverse bottom line, a kind of central tab is formed between the incisions, the edge of which will constitute the low transverse edge of the bottom line, surrounded on either side by two lateral ends of bottom line rising higher than the tab edge. In this case the crotch bottom is prepared in the shape of two separate crotch pieces; the low edge of the front tab is sewn, situated in the middle of the first bottom line, in the middle of the second facing bottom line and the two separate crotch pieces are sewn between the ends of the first bottom line and the ends facing the second bottom line.

If the second bottom line is formed by a single incision, normally on the rear face, this second bottom line after lateral extension of the incision is substantially a rectilinear transverse or slightly arched line. Advantageously, the length of the cuts at the front and at the back is not the same: the length of the cut at the back is normally superior to that of the cuts at the front so as to form two transverse bottom lines which have a substantially equivalent transverse extension.

Thus, according to this embodiment, there is a method for manufacturing a boxer short comprising the circular knitting of a main tube, the preparation of a crotch bottom, the cutting in the low portion at the front and at the back of the incisions tube, the opening of the incisions for forming first and second bottom lines and the sewing of the crotch bottom to the bottom lines to form the crotch and the thighs passage and for confectioning the boxer short, characterized in that we cut at the front two incisions forming, by opening of the incisions, a first bottom line composed, on the one hand, of a low edge of front tab between the two incisions and, on the other hand, of two lateral ends of bottom line rising higher than the tab edge, in that an incision is cut at the back forming, by opening of the incision, a second bottom line, in that the crotch bottom is prepared in the shape of two separate crotch pieces, and in that said front tab edge is sewn, situated in the middle of the first bottom line, in the middle of the second bottom line and in that the two separate crotch pieces are sewn between the ends of the first bottom line and the ends of the second bottom line.

The second bottom line is situated, after confection, at the rear side of the boxer short, so that the tab portion fastened thereto and which comes from the front portion, seamlessly surrounds, and therefore without discomfort, the genitals of the wearer. The two crotch pieces are rejected on the edges of the tab and participate in the formation of the thigh passages.

In a variant of this same embodiment, it may be provided that the second bottom line is equally formed by two substantially vertical and symmetrical incisions, in which case there is formed by extension of the incisions, a central tab provided with a low edge: the low edge of the first tab is sewn on the low edge of the second tab and the separate crotch pieces are sewn between the ends facing the first and the second bottom line. In this variant, the length of the two cuts at the front and at the back is advantageously the same, so as to form two transverse bottom lines which have a substantially equivalent transverse extension.

According to a second embodiment, the two incisions formed at the front and/or at the back of the knitted tube are in the shape of a double T incision, that is to say an incision including the T base starting from the edge of the knitted fabric and the T-bar transversely disposed at the base. When the knitted fabric is laterally stretched to open this double T incision and form the first globally transverse bottom line, a low edge is laterally formed on either side of a central portion of the bottom line which rises higher than the edge situated at the two ends of the bottom line. In this case a crotch bottom in the shape of only one separate central piece is prepared; the low double lateral edge situated at the ends of the first bottom line is sewn to the portions facing the ends of the second bottom line and the central piece is sewn separate from crotch between the central portion rising higher than the first bottom line and the central portion facing the second bottom line.

The shape of the two incisions forming a T may admit variations: for example the branches of the T bar may be curves and/or may not be completely at right angle with respect to the T base.

If the second bottom line is formed by a single incision, normally on the rear face, this second bottom line after lateral extension of the incision is substantially a rectilinear transverse or slightly arched line. Advantageously, the length of the cut at the back is superior to that of the T at the front so as to form, at the back and at the front, two transverse bottom lines which have a substantially equivalent transverse extension.

In a variant of this same second embodiment, it can be provided that the second bottom line is also formed by two incisions forming a T, in which case a bottom line substantially resembling the first bottom line is formed by extension, with a low edge on either side of a higher central portion. The low edges facing the two bottom lines are sewn to one other, and the central piece separate from the crotch is sewn between the less low central portions of the facing bottom lines. In this variant as in the others, the length of the two cuts at the front and at the back is provided so as to form two transverse bottom lines which have a substantially equivalent transverse extension.

Thus according to the invention, it is understood that the at least one of the two bottom lines obtained by incisions and lateral stretching is not exclusively rectilinear transverse but on the contrary, though always globally transverse, it comprises, on the one hand, a low transverse edge (in one portion, for example central portion, or in many portions, for example lateral portions) and, on the other hand, a top edge of bottom line rising higher than the low transverse edge (this top edge being possibly in two portions, for example lateral portions, or in one portion, for example central portion), whereby, when this non rectilinear bottom line is placed facing the other bottom line, the low edge can be directly sewn to the other line and the crotch piece(s) can be placed between the top edge and the other line.

We used here the verb "sew", but it is clear that this term does not only cover the seam with a thread, but any method allowing to assemble edge to edge two textile pieces.

As said above, the second bottom line is advantageously substantially rectilinear or arched in shape. It is understood that in this case, said low edge of the second bottom line extends over the entire length of the bottom line.

The first bottom line is advantageously in the shape of broken line.

The low edge of first bottom line (for example that of the tab in the first embodiment) may be formed by the low border of the circular knitted fabric itself, after possible unrolling of the lapel which was formed during knitting when appropriate, or long after a transverse complementary cut at the front, between the incisions, to remove the lapels.

The crotch portion(s) is/are advantageously obtained also by knitting, the two pieces (when there are two) can be easily formed from a common draft, which may be obtained from a transversely cut strip. The crotch portion(s) can also come from another knitted fabric than the knitted fabric of the boxer short itself, another jersey type material. These two portions may, according to their material, possibly bring an additional benefit to the product: ventilation ("mesh" type material), anti-friction type material, anti-irritation treated material, etc.

The invention also relates to a boxer short obtained by the method above.

It is about a boxer short formed in a knitted main tube, including a front and a back linked in low portion by a crotch bottom separating two thigh passages, the low portions of the front and of the back ending with a first and a second bottom line globally transverse between which the crotch bottom is sewn, characterized by a first globally transverse bottom line composed, on the one hand, of a low transverse edge and, on the other hand, of a top edge of bottom line rising higher than the low transverse edge, a second bottom line having at least one low transverse edge, in that said low transverse edge of the first bottom line is sewn to a portion facing the low transverse edge of the second bottom line, and in that the crotch bottom is in the shape of at least one separate crotch piece sewn between the top edge of the first bottom line and a portion facing the second bottom line.

In a particular case of embodiment, it is about a boxer short formed in a knitted main tube, including a front and a back linked in low portion by a crotch bottom separating two thigh passages, the low portions of the front and the back ending with a first and a second bottom line between which the crotch bottom is sewn, characterized by a first bottom line composed, on the one hand, of an edge of front tab and, on the other hand, of two lateral ends of bottom line rising higher than the edge of tab, in that the crotch bottom is in the shape of two separate crotch pieces, and in that that said edge of front tab, situated in the middle of the first bottom line, is sewn in the middle of the second bottom line and in that the two separate crotch pieces are sewn between the ends of the first bottom line and the ends of the second bottom line.

BRIEF DESCRIPTION OF THE DRAWINGS

Other features and advantages of the invention will appear from the following description. Reference will be made to the accompanying drawings on which:

FIGS. 10A to 13'C represent various embodiments of the incisions at the front and at the back of the tubular knitted fabric, and FIGS. 10'A and 12'A, similar to FIGS. 3 and 8, illustrate the shape of the crotch obtained according to the method of the invention. More precisely, FIG. 10A describes the first preferred embodiment of the invention, with two front vertical symmetrical incisions, one back vertical incision, with in FIG. 10'A the illustration of the corresponding crotch.

FIG. 13A describes an alternative variant of the second preferred embodiment of the invention, with two front and back T-shaped incisions, with, in FIG. 13'A, the illustration of the corresponding crotch.

FIGS. 13B and 13C are two variants of this second embodiment, where the incision forming the front T-bar has a curved or oblique shape on the horizontal, with, in FIG. 13'C, the illustration of the crotch corresponding to FIG. 13C.

DETAILED DESCRIPTION

Figure 1:
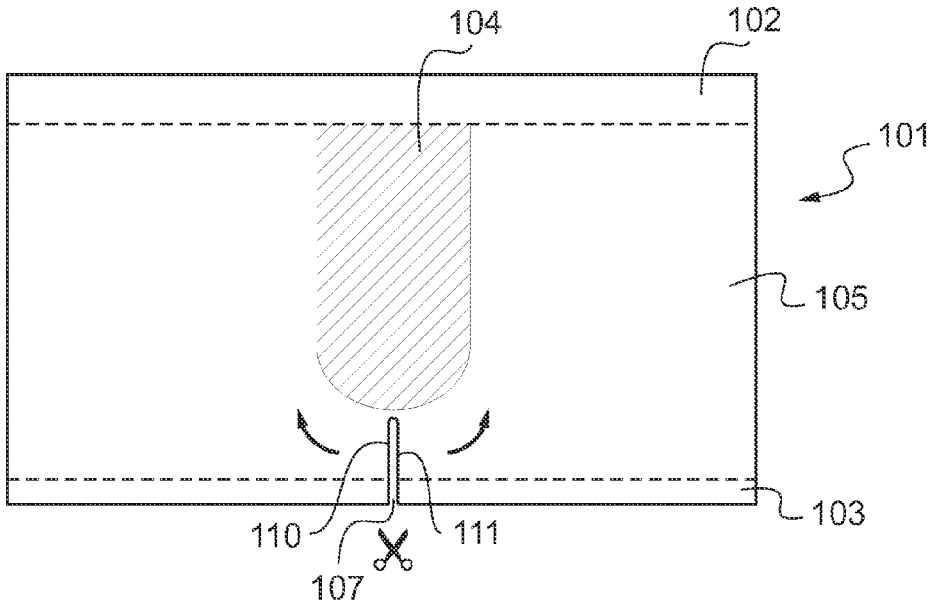
FIG. 1 schematically represents in a front view a knitted tube at the first step of its confection, according to the prior art.
Figure 2:
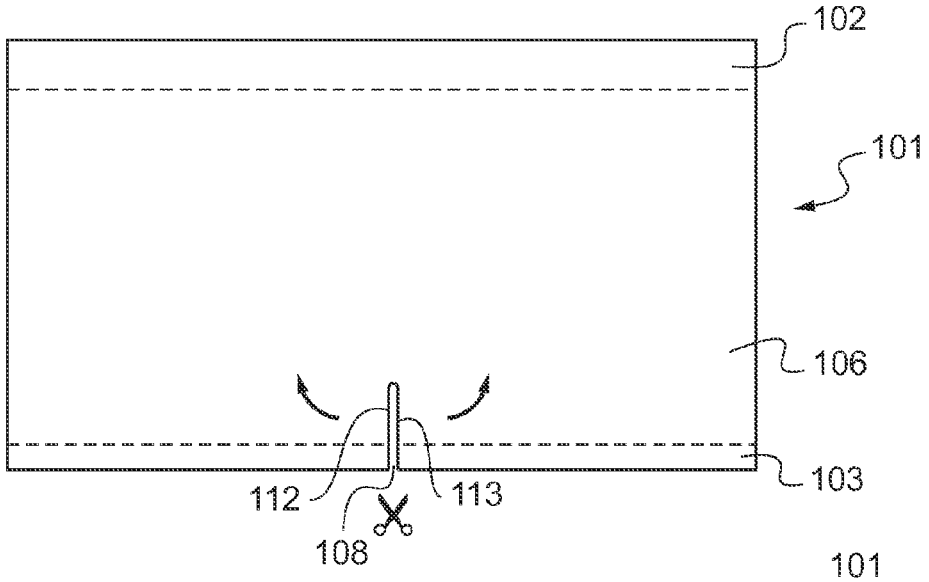
FIG. 2 schematically represents in a back view a knitted tube at the first step of its confection, according to the prior art.
Figure 3:
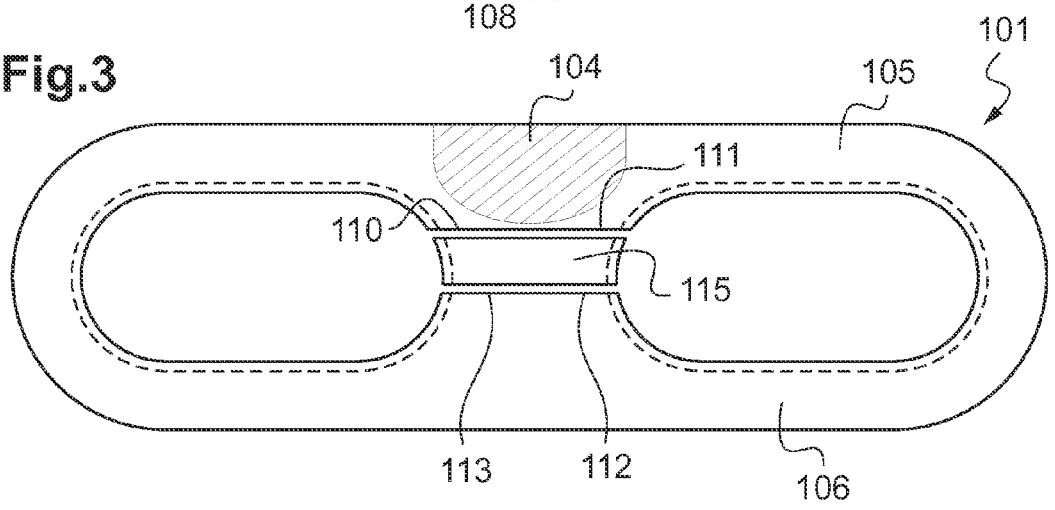
FIG. 3 schematically represents in a bottom view the knitted tube of FIGS. 1 and 2, after sewing of the crotch bottom, according to the prior art.

The enclosed FIGS. 4 to 8 show in detail the confection operation of a boxer short according to the invention according to a first preferred embodiment. As according to the prior art, the boxer short 1 is made in the shape of a knitted tube, with an upper belt 2 and a lower border 3 corresponding to future leg cuffs. The knitted tube comprises a front face 5 and a rear face 6. It is further represented in hatching on the front face 5 of the portion 4 intended to form the front pocket of the boxer short intended to maintain the genitals. There is defined on the knitted tube a vertical direction going from the belt 2 at the top to the lower border 3 and a transverse direction, orthogonal to the vertical direction, and going from one side of a front or rear face to the other.

According to the invention, we proceed (FIGS. 4 and 5) to a cut operation creating two parallel vertical incisions 7 and 7' at the front 5 of the boxer short 1: these incisions have edges 10, 11 and 10', 11' and form a tab 14 having a lower edge or low edge 16. The lower edge 16 may be directly the edge of the knitted tube if the lapel is not formed yet, or be the edge of the tab 14 after dismantling the lapel, or even—and preferably—be obtained by the shortening of the tab 14 through an additional transverse cut (not represented) between the two incisions 7, 7'. In practice, the contour portion 4 may advantageously go lower than it has been represented on FIGS. 4 and 8 (to avoid confusing the reading) and come in the tab 14 between the two edges 11, 11' and almost until to its low edge to ensure more comfort to the genitals.

We proceed at the back part 6 of the knitted tube to a central vertical incision 8, creating two edges 12, 13.

Figure 6:
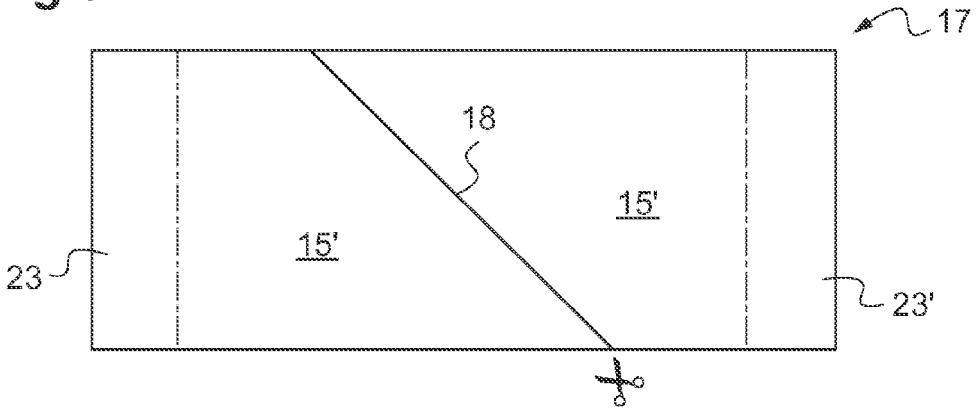
FIG. 6 is a view of a crotch draft according to the invention.
Figure 7:
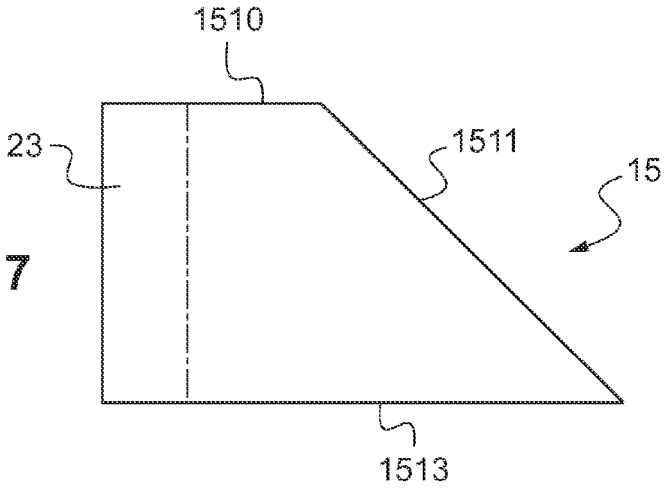
FIG. 7 is a view of a lateral crotch piece according to the invention.

We also prepared, preferably in a knitted fabric, two lateral crotch pieces 15, 15' in one piece 17 represented in FIG. 6, which can itself be obtained by cutting a long knitted strip. The piece 17 includes, on its two edges, borders 23, 23' with lapels corresponding to portions 3 of the tubular knitted fabric 1 intended to form the thigh passage. An oblique cut 18 allows to form, from the piece 17, two pieces 15 and 15' symmetrical in rectangular trapezia. The piece 15, represented on FIG. 7, includes, in addition to its reinforced edge 23, parallel edges 1510 and 1513 and an oblique edge 1511.

We then go to the sewing of the crotch pieces 15, 15' on the knitted tube. For that, each incision 7, 7' is laterally spaced apart, in the transverse direction, so as to put the edges 10, 11 and 10', 11' substantially in the shape represented in FIG. 8, where they are at an obtuse angle together, always with the tab 14 therebetween and the edge 16 thereof at low portion. These elements form a broken front bottom line 10, 11, 16, 11', 10', in which the edge 16 is a low edge and the portions 10, 11, 11', 10' a top edge (with respect to the low edge). In the same time, the incision 8 is spaced apart so as to put the edges 12, 13 substantially in the extension of one another, as represented, so as to form a practically rectilinear rear bottom line 12, 13.

the low edge 16 is then sewn in the middle of the rear bottom line 12, 13, in the portion facing the low edge 16, and the lateral crotch trapezia 15, 15' are attached and sewn between the lateral portions of front bottom line 10, 11 and 10', 11' constituting the top edge and the ends of the rear bottom line 12, 13. The lateral crotch trapezia 15, 15' therefore participate in the constitution of each thigh girth 19 by the reinforced edge 23, 23'.

The shape of the lateral crotch pieces 15, 15' is not limited to the trapezium. These pieces can also be triangular, or of other shape, and their edges are not necessarily rectilinear, but may be curves. Likewise, the rear bottom line 12, 13 represented rectilinear on FIG. 8 can be arched, curvilinear or broken.

Figure 9:
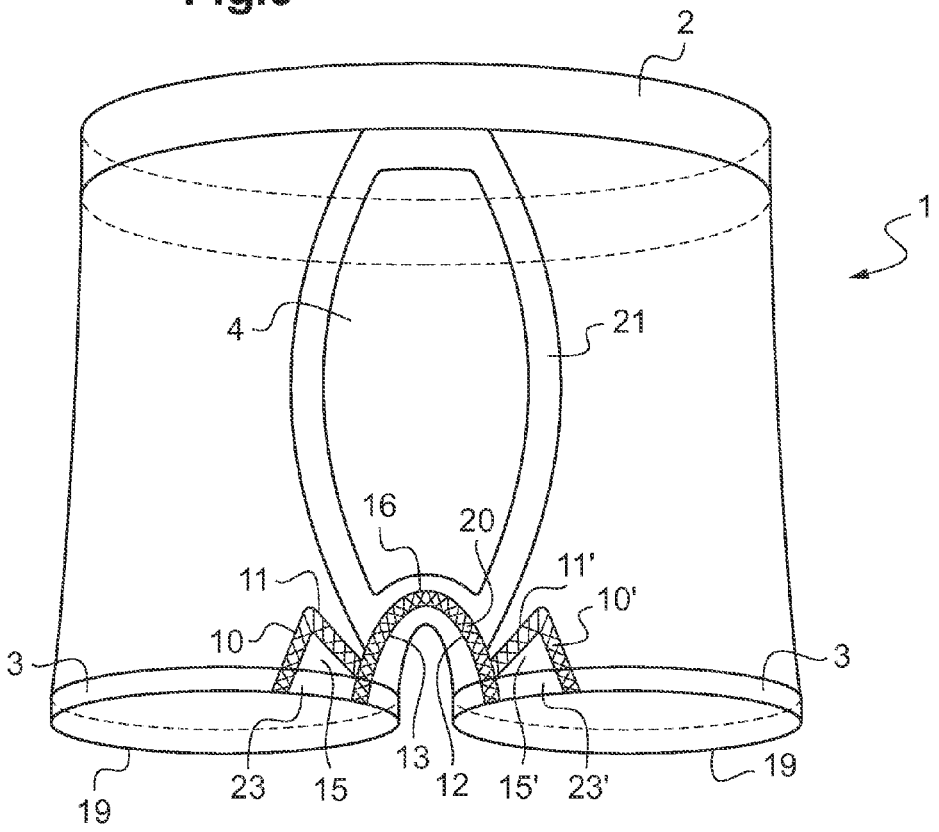
FIG. 9 represents in perspective in a low angle view a particular example of embodiment of a boxer short in accordance with the invention.

An example of a boxer short obtained in accordance with the invention is represented on FIG. 9. It shows the lateral crotch pieces 15, 15', placed inwardly and forwardly of each thigh. The front edge 16 forms with the rear bottom line 12, 13 a seam 20 which extends more or less in an arc between the thighs; two sewing branches go from this seam 20, sewing the lateral pieces 15, 15' at the edges 10, 11, 10', 11'. The fact that the front edge 16 joins the rear bottom line 12, 13 situated at the back allows to carry to the back the seam and the resulting discomfort in a less sensitive zone, which significantly contributes to the improved comfort of the boxer short of the invention.

The invention is particularly well combined with an embodiment of the front contoured portion in the more or less oval zone 4 shape surrounded by a peripheral marginal zone 21 made within a mesh different from that of the zone 4, advantageously a more elastic mesh (higher elasticity module).

On FIGS. 4 to 8 the preferred embodiment of the invention was described in detail, but it will be seen on FIGS. 10 to 13 that we can, without departing from the spirit of the invention, bring several modifications to what has been described, according to the exact way with which the two incisions are made on the face that receives them, and on the number of incisions on the other face. Figures are too schematic to allow to easily understand the principle of the modifications. The tube 1 is represented with its front face 5 and rear face 6, either in perspective, or in a bottom view after assembling the crotch.

Figure 4:
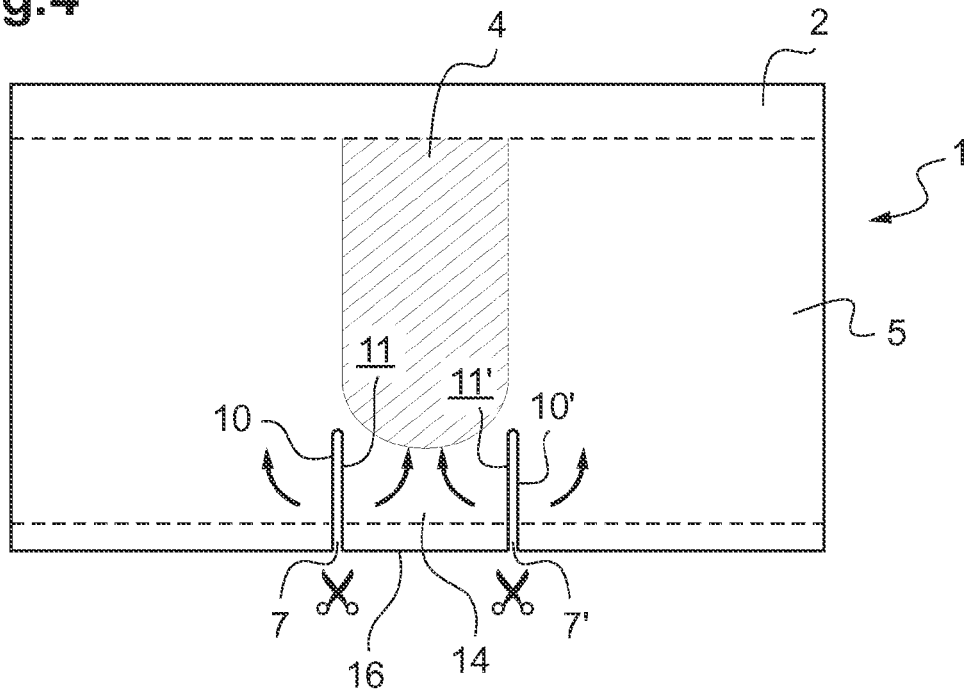
FIG. 4 schematically represents in a front view a knitted tube at the first step of its confection, according to the invention.
Figure 5:
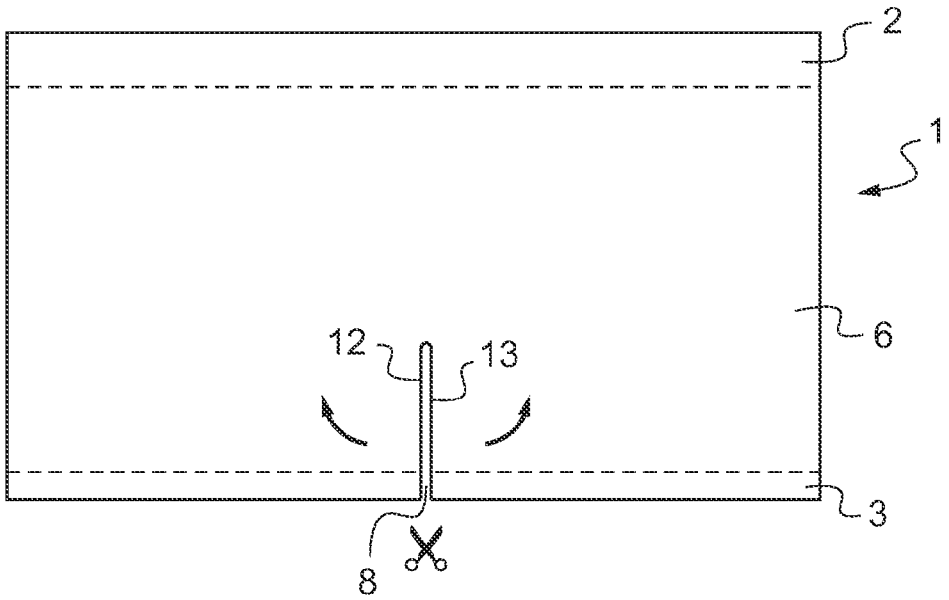
FIG. 5 schematically represents in a back view a knitted tube at the first step of its confection, according to the invention.
Figure 8:
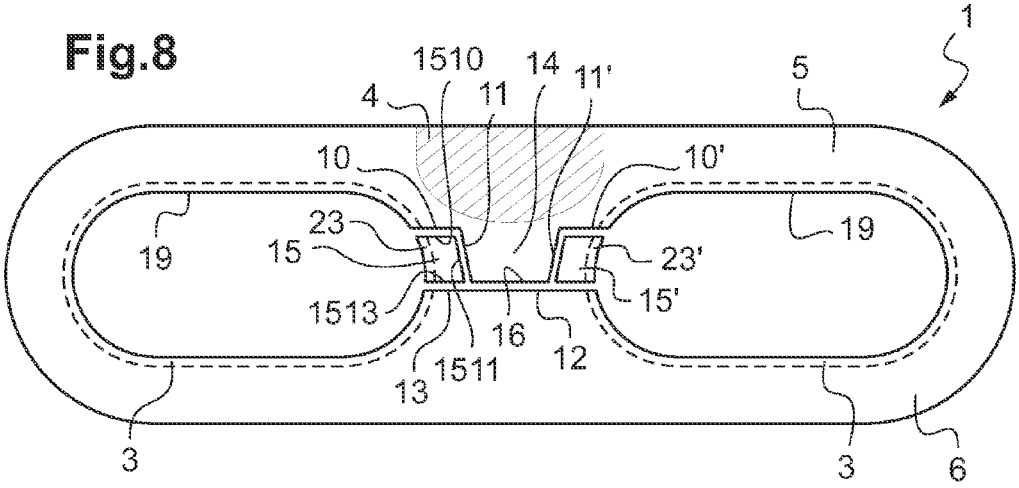
FIG. 8 schematically represents in a bottom view the knitted tube of FIGS. 4 and 5, after sewing of the two lateral pieces of the crotch bottom, according to the invention.
Figure 10A:
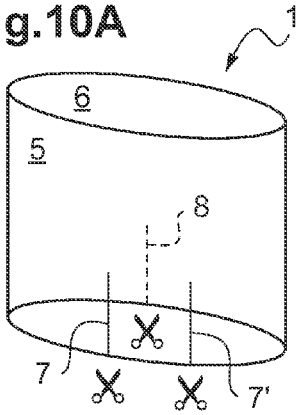
Figure 10A:
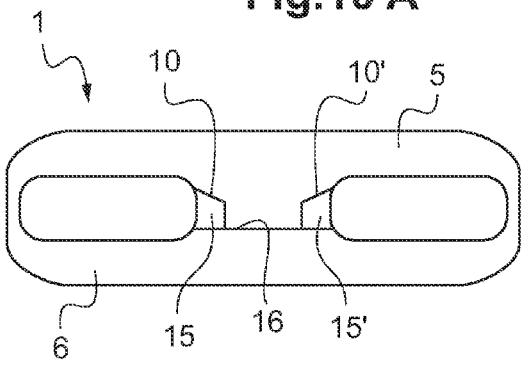

On FIGS. 10A and 10'A is resumed the basic construction of FIGS. 4-5 and 8, with two symmetrical vertical incisions 7, 7' at the front and one 8 in the middle at the back, which allow to obtain a globally transverse bottom line at the front formed of a low central edge 16 and of a top double lateral edge 10, 10' (the vertical portion, which passes from one to the other, is neglected). This front bottom line cooperates with a substantially rectilinear rear bottom line to which it is directly sewn at the low edge 16, and linked by means of the crotch pieces 15, 15' on the ends.

Figure 10B:
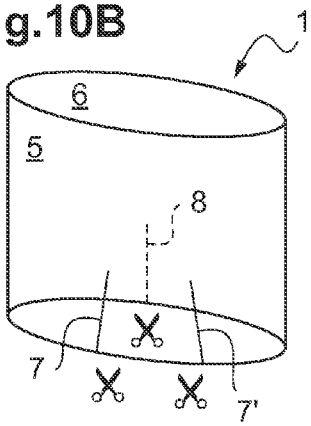
FIGS. 10B and 10C are two variants of this first embodiment, where the frontal symmetrical incisions are oblique.
Figure 10C:
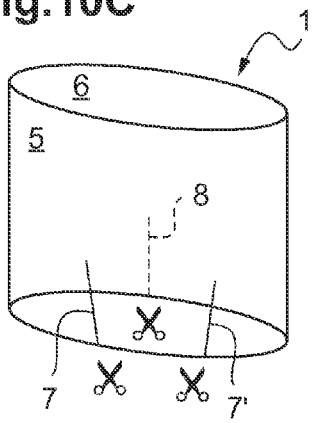

The variations of FIGS. 10B and 10C are distinguished by the symmetrical slightly oblique position of the front incisions 7, 7'.

Figure 11A:
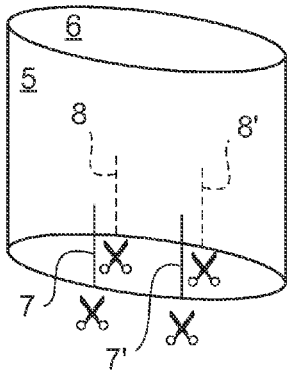
FIG. 11A describes an alternative variant of the first preferred embodiment of the invention, two front symmetrical vertical incisions, two back vertical symmetrical incisions, with in FIG. 11'A, the illustration of the corresponding crotch.
Figure 11A:
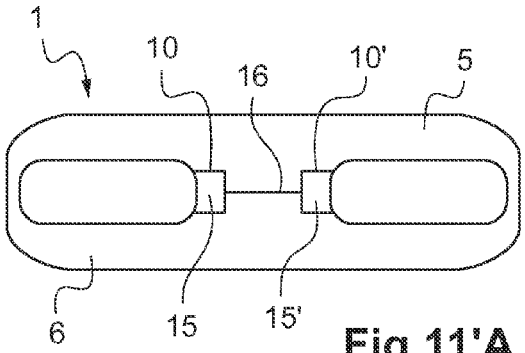

According to FIGS. 11A and 11'A, we provided two vertical symmetrical incisions 7, 7' at the front and 8, 8' at the back, thus this results in two quite similar front and rear bottom lines which are directly sewn to one another by their low edge 16 and on the sides by means of the separate crotch pieces 15, 15'.

Figure 11B:
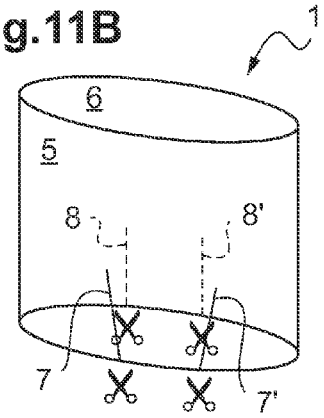
FIGS. 11B and 11C are two variants of this first embodiment, where the frontal symmetrical incisions are oblique.
Figure 11C:
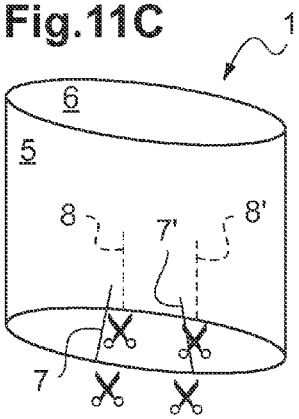

The variations of FIGS. 11B and 11C are distinguished by the slightly oblique symmetrical position of the front incisions 7, 7'.

Figure 12A:
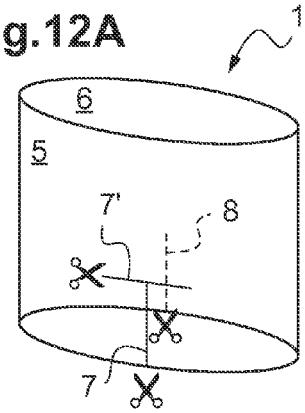
FIG. 12A describes the second preferred embodiment of the invention, with two front T-shaped incisions, a back vertical incision, with, in FIG. 12'A, the illustration of the corresponding crotch.
Figure 12A:
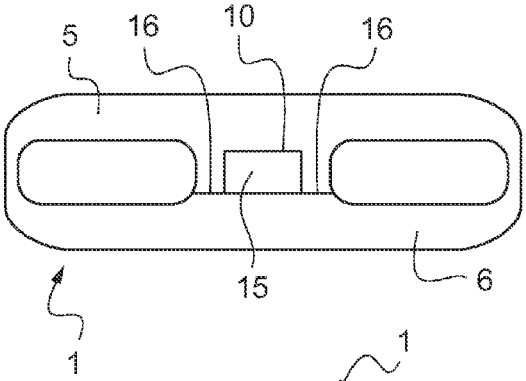

According to FIGS. 12A and 12'A, a vertical central incision 8 was provided at the back, and two central T-shaped incisions, 7, 7' were provided at the front, thus this results in that the rear bottom line is still rectilinear and that the front bottom line is characterized by a low edge 16 rejected on the sides while its top edge 10 directly formed by the incision 7' is central. The low edge 10 at the ends is directly sewn to the portion facing the rear bottom line, while the top central edge 10 is sewn to the portion facing the rear bottom line by means of the separate central crotch piece 15.

Figure 12B:
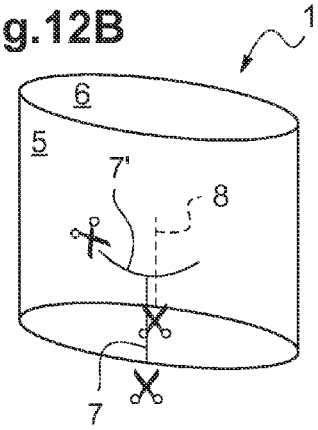
FIGS. 12B and 12C are two variants of this second embodiment, where the incision forming the T-bar has a curved or oblique shape on the horizontal, with, in FIG. 12'C, the illustration of the crotch corresponding to FIG. 12C.
Figure 12B:
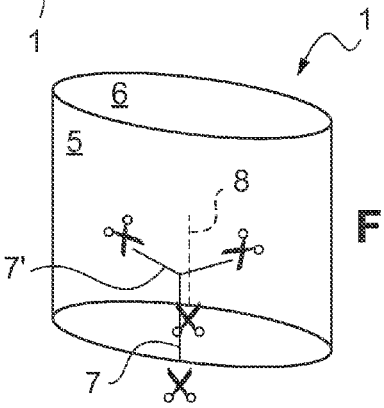
Figure 12C:
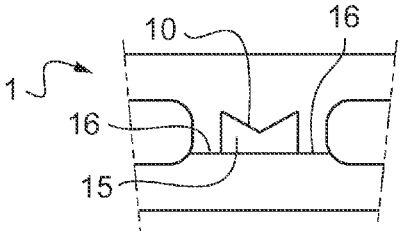

The variations of FIGS. 12B and 12C are distinguished by the curved or oblique shape of the T branches, that is to say, of the second incision 7', which leads as it is seen on FIG. 12'C to a slightly modified shape of the top edge 10 and therefore of the separate crotch piece 15.

According to FIGS. 13A and 13'A, a double incision in T 7, 7' and 8, 8' is provided at the front and at the back, which leads to two bottom lines of identical shape which will be sewn edge to edge at their end portions end forming the low edge 16 and by means of a central crotch piece 15 at their top edge 10.

The variations of FIGS. 13B and 13C are again distinguished by the curved or oblique shape of the T branches, that is to say, of the second incision 7', 8' of the incisions of the front face and rear face, which leads as it is seen on FIG. 13'C to a slightly modified shape of the top edge 10 and therefore of the separate crotch piece 15.

The invention claimed is:

1. A method for manufacturing a boxer short comprising circular knitting fabric to form a main tube having a front and a back, preparation of a crotch bottom including a crotch piece, cutting an incision in a low portion at the back of the tube, cutting two incisions at the front of the tube, opening the incisions at the front and back of the tube by lateral extension thereof to form a first and second transverse bottom line, the first bottom line at the front of the tube and the second bottom line at the back of the tube, sewing a portion of the crotch bottom to the first and second transverse bottom lines to form a crotch and a thighs passage and for confectioning the boxer short, wherein the first bottom line comprises a low transverse edge and a top transverse edge rising higher on the tube than the low transverse edge, and wherein the low transverse edge of the first bottom line is sewn to a portion of the second bottom line facing the low transverse edge and, wherein the crotch piece is sewn between the top edge of the first bottom line and a portion of the second bottom line.

2. The method according to claim 1, wherein the two incisions at the front of the knitted tube are rectilinear symmetrical incisions with respect to a median axis of the front of the tube, and vertical or slightly oblique with respect to a vertical axis of the tube.

3. The method according to claim 1, wherein the two incisions at the front of the tube are substantially vertical and symmetrical incisions, so that when the knitted fabric of the tube is laterally stretched to open these incisions and form the first bottom line, a central tab is formed between the incisions, the edge of the central tab comprising the low transverse edge of the first bottom line, surrounded on either side by two lateral ends of the first bottom line rising higher on the tube than the edge of the central tab, the two lateral ends facing the second bottom line, wherein the crotch bottom comprises two separate crotch pieces;

wherein the low transverse edge of the central tab is sewn, situated in the middle of the first bottom line, and in the middle of the second bottom line, and wherein the two separate crotch pieces are sewn between the two lateral ends of the first bottom line.

4. The method according to claim 1, wherein the two incisions at the front of the tube comprise a T-shaped double incision comprising a base portion extending from a low portion of the tube and a bar portion transversely disposed relative to the base, so that when the knitted fabric of the tube is laterally stretched to open the T-shaped double incision and form the first bottom line, the low edge of the first bottom line is laterally formed on either side of a central portion of the first bottom line that rises higher on the tube than the low edge situated at opposing ends of the first bottom line, wherein the crotch bottom consists of only the crotch piece, wherein the low edge situated at the ends of the first bottom line is sewn to respective end portions of the second bottom line and wherein the crotch piece is sewn between the central portion of the first bottom line and a central portion of the second bottom line.

5. The method according to claim 1, wherein the second bottom line is substantially rectilinear or arched in shape.

6. The method according to claim 1, wherein the first bottom line comprises a broken line.

7. The method according to claim 1, wherein the low edge of the first bottom line is formed by a low border of the knitted fabric tube.

8. The method according to claim 7, wherein the low edge of the first bottom line is formed by the low border of the knitted fabric after unrolling of a lapel that was formed during the knitting of the knitted fabric tube.

9. The method according to claim 7, wherein the low edge of the first bottom line is formed by the low border of the knitted fabric tube after a transverse complementary cut at the front of the tube, between the two incisions.

10. The method according to claim 1, wherein the crotch piece is formed by knitting.

11. A boxer short formed in a knitted main tube, comprising:

a front and a back linked in low portion by a crotch bottom separating two thigh passages, the low portions of the front and of the back ending with a first and a second transverse bottom lines between which the crotch bottom is sewn, wherein the first bottom line comprises a low transverse edge and a top transverse edge rising higher on the tube than the low transverse edge, wherein the second bottom line comprises a transverse edge, wherein the low transverse edge of the first bottom line is sewn to a portion of the transverse edge of the second bottom line facing the low transverse edge of the first bottom line, and wherein the crotch bottom comprises a crotch piece sewn between the top edge of the first bottom line and the portion of the second bottom line.

12. A boxer short formed in a knitted main tube, comprising:

a front and a back linked in low portion by a crotch bottom separating two thigh passages, with respective low portions of the front and the back terminating in a first bottom line on the front of the tube and a second bottom line on the back of the tube, between which the crotch bottom is sewn, wherein the first bottom line comprises an edge of a front tab and two lateral ends rising higher on the tube than the edge of the front tab, wherein the crotch bottom comprises two separate crotch pieces, wherein the edge of the front tab is situated in the middle of the first bottom line and sewn in the middle of the second bottom line, and wherein the two separate crotch pieces are sewn between the two lateral ends of the first bottom line and respective ends of the second bottom line.

* * * * *